US010465977B2

(12) United States Patent
Lee et al.

(10) Patent No.: US 10,465,977 B2
(45) Date of Patent: Nov. 5, 2019

(54) REFRIGERATOR

(71) Applicant: Samsung Electronics Co., Ltd., Suwon-si (KR)

(72) Inventors: Young Seok Lee, Seoul (KR); Ji Hyeoung Lee, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 55 days.

(21) Appl. No.: 15/665,939

(22) Filed: Aug. 1, 2017

(65) Prior Publication Data

US 2018/0058749 A1 Mar. 1, 2018

(30) Foreign Application Priority Data

Aug. 29, 2016 (KR) ..... 10-2016-0110235

(51) Int. Cl.

| | |
|---|---|
| ***F25D 23/12*** | (2006.01) |
| ***B67D 1/00*** | (2006.01) |
| ***B67D 1/08*** | (2006.01) |
| ***B67D 1/12*** | (2006.01) |
| ***F25D 23/02*** | (2006.01) |

(52) U.S. Cl.

CPC ..... *F25D 23/126* (2013.01); *B67D 1/0014* (2013.01); *B67D 1/0858* (2013.01); *B67D 1/0894* (2013.01); *B67D 1/1234* (2013.01); *F25D 23/028* (2013.01); *B67D 2210/00036* (2013.01)

(58) Field of Classification Search

CPC ... F25D 23/126; B67D 1/0014; B67D 1/0894; B67D 1/1202

USPC ..... 141/198

See application file for complete search history.

(56) References Cited

U.S. PATENT DOCUMENTS

| | | | | |
|---|---|---|---|---|
| 6,425,425 | B2 * | 7/2002 | Bianchi | B67D 1/0085 141/351 |
| 7,007,500 | B2 * | 3/2006 | Lee | F25C 5/005 222/146.6 |
| 7,316,121 | B2 * | 1/2008 | Lee | F25D 23/025 62/344 |
| 7,455,085 | B2 * | 11/2008 | Voglewede | F25D 23/126 141/18 |
| 7,866,165 | B2 * | 1/2011 | Jang | F25C 1/24 222/146.6 |

(Continued)

FOREIGN PATENT DOCUMENTS

| | | |
|---|---|---|
| KR | 10-2008-0111804 | 12/2008 |
| KR | 10-2009-0020951 | 2/2009 |

(Continued)

*Primary Examiner* — Timothy L Maust
(74) *Attorney, Agent, or Firm* — Staas & Halsey LLP

(57) ABSTRACT

A refrigerator capable of supplying water without opening a door and deteriorating the aesthetic quality of the refrigerator is provided. The refrigerator includes a main body in which a food storage space is formed, a door to open or close one side of the main body and a water dispensing member having an outlet. The water dispensing member is provided so as to be movable in the forward and backward directions and located at a first position at which the water dispensing member is accommodated in the door or at a second position at which the water dispensing member protrudes forward from the door.

18 Claims, 9 Drawing Sheets

(56) References Cited

U.S. PATENT DOCUMENTS

| | | | | |
|---|---|---|---|---|
| 8,701,436 | B2 * | 4/2014 | Kim | F25D 23/028 141/362 |
| 10,246,317 | B2 * | 4/2019 | Kapure | B67D 3/0003 |

FOREIGN PATENT DOCUMENTS

| | | |
|---|---|---|
| KR | 10-2013-0037301 | 4/2013 |
| WO | WO 2015/057344 A1 | 4/2015 |

* cited by examiner

REFRIGERATOR

CROSS-REFERENCE TO RELATED APPLICATION(S)

This application claims the benefit of Korean Patent Application No. 10-2016-0110235, filed on Aug. 29, 2016 in the Korean Intellectual Property Office, the disclosure of which is incorporated herein by reference.

BACKGROUND

1. Fields

Embodiments of the present disclosure relate to a refrigerator provided with a dispensing unit.

2. Description of the Related Art

Generally, a refrigerator is a household appliance which supplies cold air generated from an evaporator to a freezing compartment and a refrigerating compartment to maintain the freshness of various foods for a long period of time. The freezing compartment stores foods that should be kept below the freezing temperature, such as meat, fish, ice, and the like. The refrigerating compartment stores foods that should be kept above the freezing temperature, such as vegetables, fruits, and drinks.

The cold air supplied to the freezing compartment and the refrigerating compartment is generated by a heat exchange of refrigerant. The refrigerant exchanges heat with air while repeatedly circulating in a refrigerant cycle of compression-condensation-expansion-evaporation. The air heat-exchanged with the refrigerant is supplied to the freezing compartment and the refrigerating compartment by a circulation fan, so that the foods in the refrigerator are stored at a desired temperature.

A conventional refrigerator is provided with a dispenser to supply water without opening a door. A water bottle is disposed inside the refrigerator, and a dispenser connected to the water bottle is disposed at the door of the refrigerator. The dispenser is discharged in a recessed form inside the door, and the user can get water through a dispensing device provided in the dispenser.

Since the conventional dispenser is formed in a form in which a part of the door is recessed or protruded, the aesthetic quality of the refrigerator deteriorates and foreign substances may accumulate on the bottom surface of the recessed portion or the protruded portion, which is unsanitary. In addition, when the tray is provided under the dispenser, the water stored in the tray may be contaminated and unsanitary. When the dispenser is provided so as to protrude, a user may be hit by the protruding dispenser and become injured.

SUMMARY

Therefore, it is an aspect of the present disclosure to provide a refrigerator capable of supplying water without opening a door and without deteriorating the aesthetic quality of the refrigerator.

In accordance with one aspect of the present disclosure, a refrigerator includes a body in which a food storage space is formed, a door to open or close one side of the main body and a water dispensing member provided on the door having an outlet. The water dispensing member is provided so as to be movable in the forward and backward directions and located at a first position at which the water dispensing member is accommodated in the door or at a second position at which the water dispensing member protrudes forward from the door.

When the water dispensing member is located at the first position, a front surface of the dispensing member may be positioned on the same plane as a front surface of the door.

When the water dispensing member is located at the second position, water may be discharged through the outlet.

The refrigerator may include a sensing unit provided at one side of the water dispensing member and the water dispensing member may move from the first position to the second position when the sensing unit is contacted.

The water dispensing member may move from the second position to the first position when a contact state of the sensing unit is released.

The water dispensing may be stopped and the water dispensing member may move to the first position after water is discharged by a predetermined amount through the outlet.

The sensing unit may be positioned on the same plane as the front surface of the water dispensing member when the water dispensing member is in the first position.

The sensing unit may be located under the water dispensing member and have the same width as the water dispensing member.

The refrigerator may include a holder member provided under the water dispensing member, and the holder member may be provided to be located at a third position at which the holder member is accommodated in the door or in a fourth position at which the holder member protrudes forward from the door.

When the holder member is in the third position, a front surface of the holder member may be positioned on the same plane as the front surface of the door when the holder member is in the third position.

The holder member may include a base on which a container is placed, and when the holder member is at the third position, the base is positioned such that one side on which the container is to be placed faces sideways.

The holder member may be configured to rotate in one direction or the other direction at the fourth position.

When the holder member rotates in one direction at the fourth position, the base may be positioned such that one side on which the container is to be placed faces upward.

The base may be provided with a movement preventing member provided to surround at least a portion of an outer circumferential surface of the container which is placed on the base so as to prevent a movement of the container.

The movement preventing member may be movable in a radial direction so as to correspond to an outer shape of the container.

In accordance with another aspect of the present disclosure, a refrigerator has a water dispensing unit provided to supply water, the water dispensing unit may include a water dispensing member provided with an outlet and configured to be linearly movable in the forward and backward directions and a holder member positioned under the water dispensing member to position a container and configured to be linearly movable in the forward and backward directions. One of the water dispensing member and the holder member may be positioned at a first position at which a front face thereof is accommodated in one side of the refrigerator and at a second position at which the front face thereof protrudes from one surface of the refrigerator.

When the water dispensing member is located at the second position, water may be discharged through the outlet.

The holder member may be positioned such that one side on which the container is to be placed faces sideways at the first position and faces upward at the second position.

The water dispensing member or the holder member may move along a rack gear extending in the forward and backward direction.

The water dispensing member and the holder member may be independently movable in the forward and backward direction.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
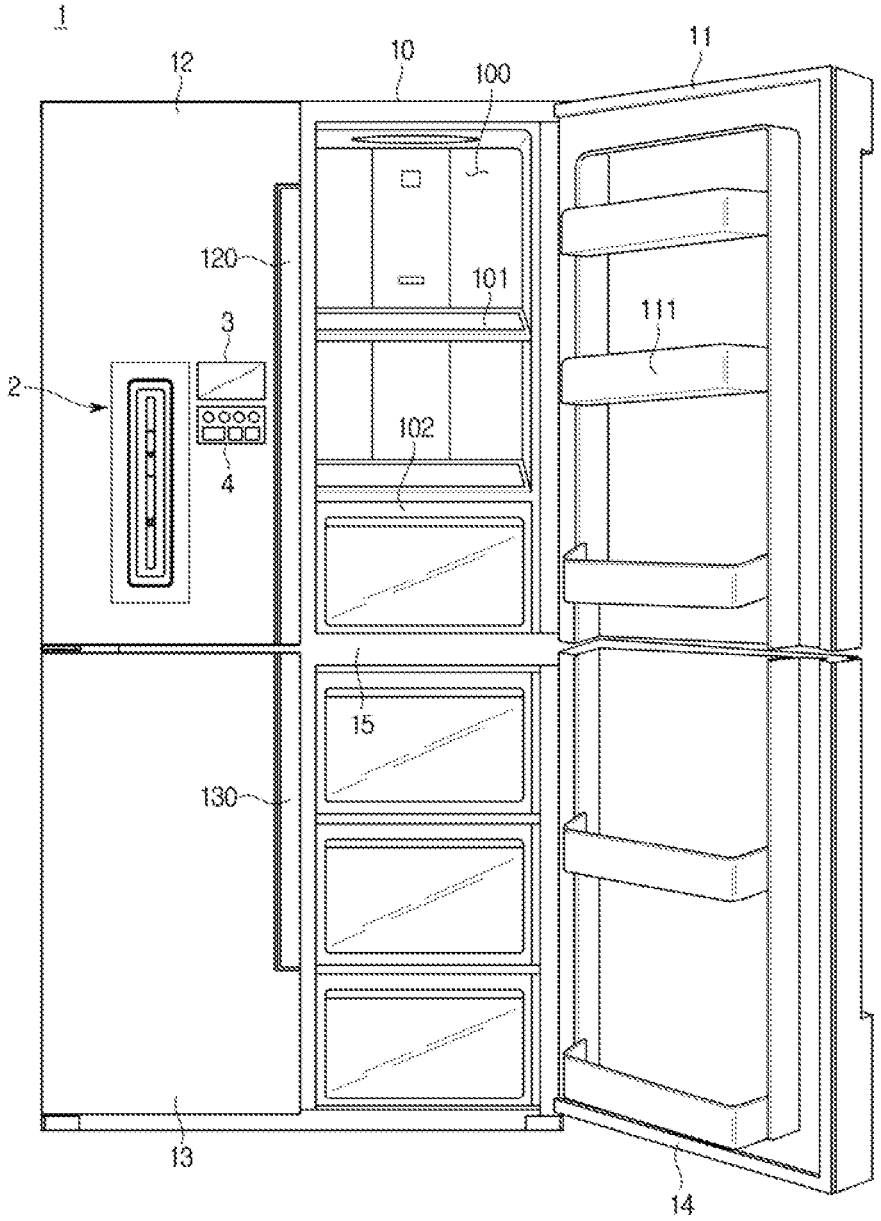
FIG. 1 is a perspective view illustrating a refrigerator according to an embodiment.

The embodiments described herein and the configurations shown in the drawings are only examples of preferred embodiments of the present disclosure, and various modifications may be made at the time of filing of the present application to replace the embodiments and drawings of the present specification.

In addition, the same reference numerals or symbols shown in the drawings of the present specification indicate components or components that perform substantially the same function.

Throughout the specification, the terms used are merely used to describe particular embodiments, and are not intended to limit the present disclosure.

As used herein, the singular forms "a," "an" and "the" are intended to include the plural forms as well, unless the context clearly indicates otherwise.

Also, it is to be understood that the terms such as "include," "have," or the like, are intended to indicate the existence of the features, numbers, operations, components, parts, or combinations thereof disclosed in the specification, and are not intended to preclude the possibility that one or more other features, numbers, operations, components, parts, or combinations thereof may exist or may be added.

It is also to be understood that terms including ordinals such as "first," "second" and the like used herein may be used to describe various elements, but the elements are not limited to the terms, it is used only for the purpose of distinguishing one component from another. For example, the first component may be referred to as a second component, and similarly, the second component may also be referred to as a first component.

The term "and/or" includes any combination of a plurality of related listed items or any of the plurality of related listed items.

Hereinafter, a refrigerator according to an embodiment will be described in detail with reference to the drawings.

FIG. 1 is a perspective view illustrating a refrigerator according to an embodiment.

Referring to FIG. 1, a refrigerator 1 according to an embodiment may include a main body 10 having an opening formed at one side thereof, and doors 11, 12, 13, 14 to open or close the opening. The doors 11, 12, 13, 14 may be provided with grips 120, 130 to facilitate opening or closing of the doors 11, 12, 13, 14. The doors 11, 12, 13, 14 may be a rotary door provided to be rotatable about a hinge.

Inside the main body 10, a food storage space 100 capable of storing food or the like may be provided. A partition 15 may be provided in an inner space of the main body 10 to be laterally disposed. The inner space of the main body 10 is partitioned into two spaces by the partition 15 so that one of the spaces may be a refrigerating compartment and the other may be a freezing compartment.

For example, an upper storage space provided by the partition 15 may be a refrigerating compartment, and a lower storage space may be a freezing compartment. The refrigerating compartment or the freezing compartment partitioned by the lateral partition 15 may be further partitioned by a longitudinal partition. Spaces partitioned by the partition 15 may be opened or closed by the plurality of doors 11, 12, 13 14, respectively.

In order to efficiently store food and the like, at least one shelf 101 may be provided in the inner space of the main body 10. The shelf 101 may be provided so as to be variable in position according to user's convenience. In addition, a basket 102, which may be drawn out, is provided in the inner space of the main body 10.

On inner side surfaces of the doors 11, 12, 13, 14, a basket 111 capable of storing food may be provided. A plurality of baskets 111 may be provided, and the basket 111 may be provided so as to be movable according to user's convenience.

The refrigerator 1 may be provided with a water dispensing unit 2 including an outlet 200 so as to provide water without opening the doors 11, 12, 13, 14. The water dispensing unit 2 may be provided in at least one of the plurality of doors 11, 12, 13, 14. Water may be supplied to the user directly from the outside of the refrigerator 1 through the water dispensing unit 2 without opening the doors 11, 12, 13, 14. Water may be supplied to the water dispensing unit 2 from an external water source of the refrigerator 1. The water dispensing unit 2 and the external water source may be connected by pipes (not shown).

Hereinafter, an embodiment in which the water dispensing unit 2 is located in the door 12 located at the upper left side of the refrigerator 1 will be described. The position of the water dispensing unit 2 is not limited to that described above.

The water dispensing unit 2 is normally received inside the door 12. The water dispensing unit 2 is received in the door 12 and may form the same plane as a front surface of the door 12. That is, when the water dispensing unit 2 is not dispensing water, the water dispensing unit 2 may be provided so as to be flush with the front surface of the door 12. When the water dispensing unit 2 is dispensing water, at least a portion of the water dispensing unit 2 may protrude forward from the door 12.

At least one of the doors 11, 12, 13, 14 may be provided with a display unit 3 for displaying an operation of the refrigerator 1. Also, at least one of the doors 11, 12, 13, 14 may be provided with an operating unit 4 for setting the operation of the refrigerator 1. The operating unit 4 may also be provided with a button for controlling an operation of the water dispensing unit 2.

Hereinafter, structures and operations of the water dispensing unit 2 will be described.

Figure 2A:
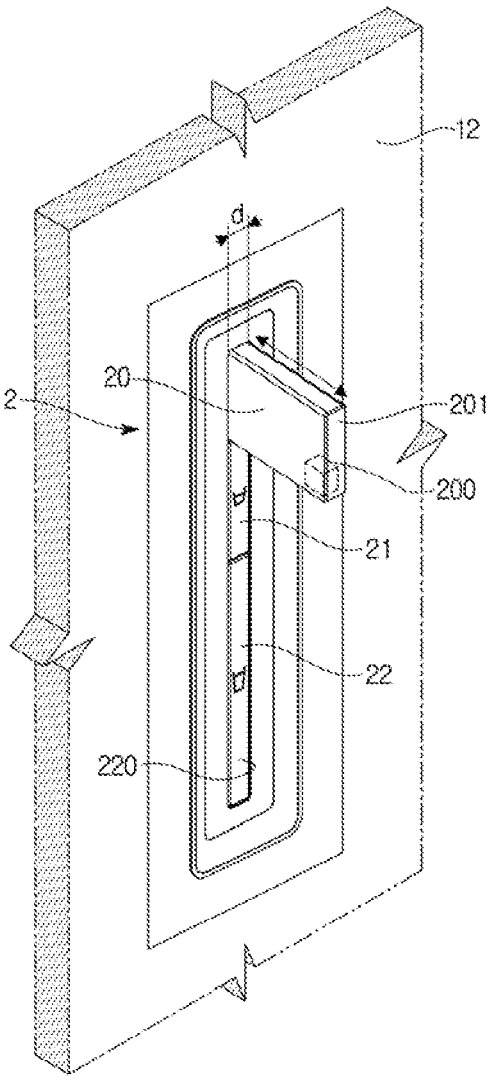
FIGS. 2A and 2B are views illustrating a water dispensing unit mounted in a door of the refrigerator according to an embodiment.
Figure 2B:
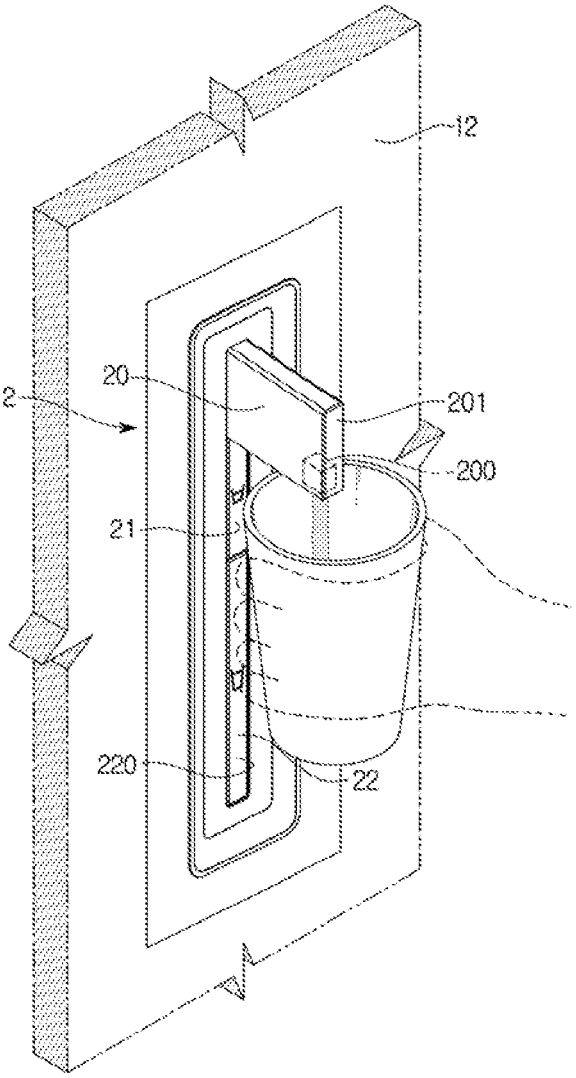

FIGS. 2A and 2B are views illustrating a water dispensing unit mounted in a door of the refrigerator according to an embodiment.

Referring to FIGS. 2A and 2B, the water dispensing unit 2 according to an embodiment may include a water dispensing member 20 having an outlet 200, a sensing unit 21 and a holder member 22. The sensing unit 21 may be positioned under the water dispensing member 20 and the holder 22 may be positioned under the sensing unit 21. The water dispensing member 20, the sensing unit 21, and the holder member 22 may have the same width d in the widthwise direction and may be arranged one after the other in the longitudinal direction. The water dispensing member 20, the sensing unit 21, and the holder member 22 may be flush with the door 12 when a water dispensing operation is not performed.

A front surface 201 of the water dispensing member 20 may be positioned substantially flush with the front surface of the door 12. The outlet 200 may be provided on the lower side of the water dispensing member 20. In order to supply water, the water dispensing member 20 may protrude forward. Water may be discharged from the outlet 200 in a state in which the water dispensing member 20 protrudes forward. The water dispensing member 20 may be provided to linearly move in the forward and backward directions. When the operation of dispensing water is finished, the water dispensing member 20 may be moved backward and accommodated in the interior of the door 12.

A front surface of the sensing unit 21 may be flush with the front surface 201 of the water dispensing member 20. The sensing unit 21 may be provided with a touch sensor or a pressure sensor. When it is sensed that the sensing unit 21 is contacted or pressed, the water dispensing member 20 may protrude forward. Water may be provided through the outlet 200 in a state in which the water dispensing member 20 protrudes forward. A user can directly touch or press the sensing unit 21 or contact or press the sensing unit 21 with a container to receive water. The sensing unit 21 may be provided in the form of a button.

After a predetermined amount of water is discharged through the outlet 200, water discharging may be stopped. When water discharging is stopped, the water dispensing member 20 may move backward and return to its original position. When the water dispensing member 20 returns to its original position, the water dispensing unit 2 may form the same plane as the door 12.

Further, water may be discharged through the outlet 200 only when the sensing unit 21 is being contacted or pressurized. When the sensing unit 21 is contacted or pressurized, the water dispensing member 20 protrudes forward and water may be discharged through the outlet 200 while the sensing unit 21 is being contacted or pressurized. When the contact state or the pressurized state of the sensing unit 21 is released, water discharging is stopped, and the water dispensing member 20 may move backward and return to its original position.

In the above, the sensing unit 21 includes the touch sensor or the pressure sensor, but may be a sensor for sensing an object located within a predetermined distance in front of the sensing unit 21. When the user's hand or a container or the like receiving water in front of the sensing unit 21 is detected by the sensor, the water dispensing member 20 protrudes forward and water may be discharged.

The water dispensing unit 2 forms substantially the same plane as the door 12, without protruding toward the front of the door 12 or being located in a space where a portion of the door 12 is recessed. Since the water dispensing unit 2 forms the same plane as the front surface of the door 12, it is possible to prevent the aesthetic quality of the refrigerator 1 from being deteriorated, and to prevent contaminants from accumulating on the protruded or recessed portions.

In addition, the user can easily get water only by touching or pressing the sensing unit 21 located under the water dispensing member 20 by using a container to receive water. The water dispensing member 20 is provided so as to protrude only when water is discharged, so that the user can easily get water using the water dispensing member 20 from the outside of the refrigerator 1, and the aesthetic quality of the refrigerator 1 can be improved.

Figure 3:
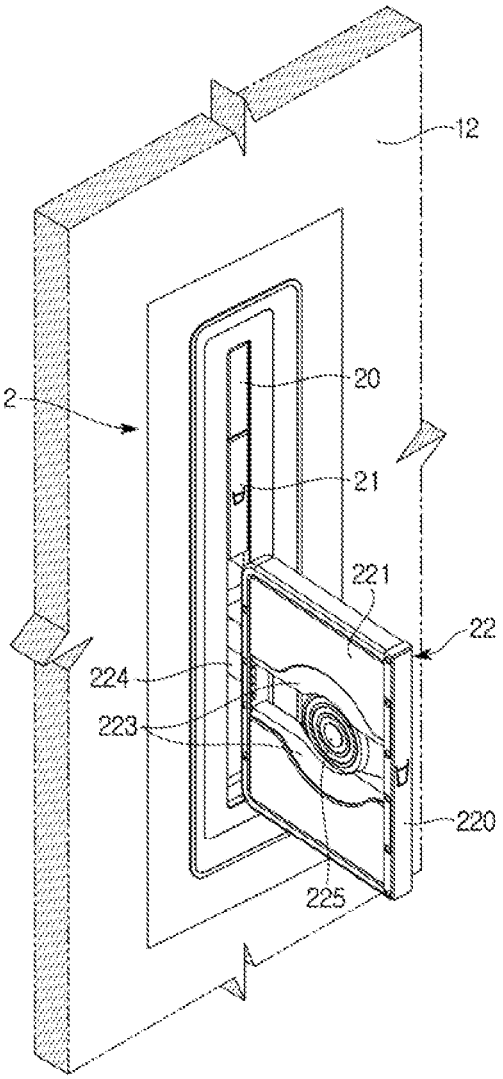
FIGS. 3 and 4 are views illustrating an appearance of the water dispensing unit in which a holder member protrudes according to an embodiment.
Figure 4:
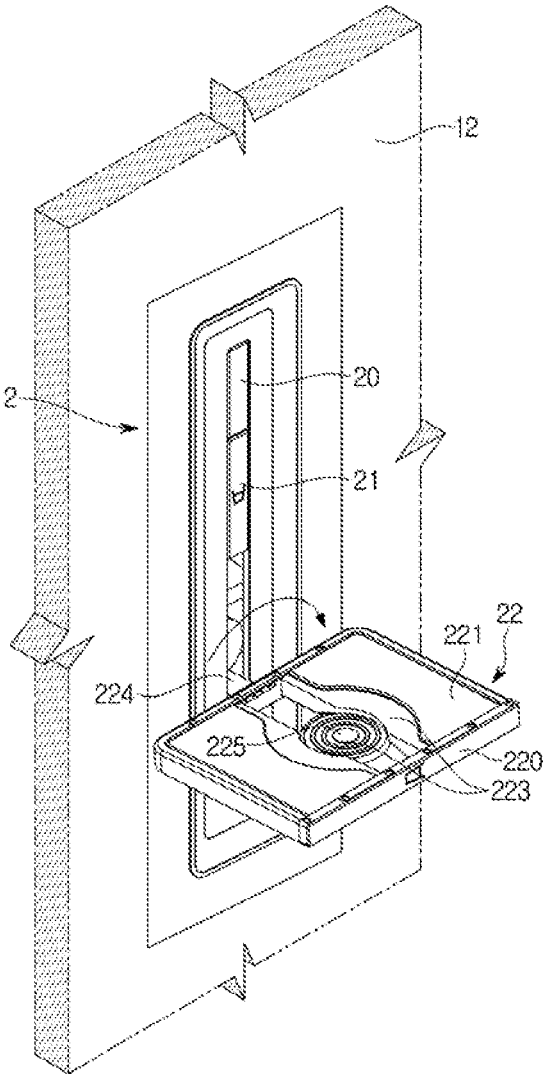

FIGS. 3 and 4 are views illustrating an appearance of the water dispensing unit in which a holder member protrudes according to an embodiment.

Referring to FIGS. 3 and 4, the water dispensing unit 2 according to an embodiment may include a holder member 22 provided so as to protrude forward. The holder member 22 is accommodated in the door 12 and may be provided to protrude forward from the door 12 only when a container to receive water is positioned on the holder member 22. When the holder member 22 is accommodated in the door 12, one surface on which the container is to be seated may be disposed standing to face sideways. After the holder member 22 protrudes from the door 12, the holder member 22 may rotate in one direction so that the one surface on which the container is to be seated faces upward.

A container is seated on the holder member 22, and the water dispensing member 20 protrudes to discharge water into the container. Water is supplied to the user while the container is supported on the holder member 22. When the water dispensing member 20 does not discharge water, the holder member 22 does not protrude from the door 12, so that the deterioration of the appearance quality of the refrigerator 1 by the holder member 22 is prevented.

The holder member 22 may be provided so as to protrude forward when operating the operating unit 4 (see FIG. 1) or operating the sensing unit 21 in a predetermined manner. For example, in order to discharge the water with the container placed on the holder member 22, the user may manipulate a button or the like provided on the operating unit 4 so that the holder member 22 protrudes. The user may manipulate the sensing unit 21 by pressing the sensing unit 21 for a predetermined time or by pressing the sensing unit 21 a plurality of times so that the holder member 22 protrudes forward. The method of protruding the holder member 22 forward is not limited to the above-described method.

The holder member 22 may include a frame 220 and a base 221 on which a container is placed. The frame 220 may be provided to surround the base 221. One side of the frame 220 may be exposed to the front of the door 12 at all times. In the above, the frame 220 and the base 221 are separately provided. However, the frame 220 and the base 221 may be integrally formed with one member.

The base 221 may be provided with a seating portion 225 on which the container is seated. The seating portion 225 may be formed by recessing a portion of the base 221. As another example, a hole may be formed in the base 221, and the container may be supported by the inner surface of the base 221 forming the hole. In this case, on the other side of the base 221, the seating portion 225 to support the container when the container is inserted into the hole may be provided.

The seating portion 225 is included in the base 221 as a portion formed on the base 221. Hereinafter, it will be described that the container is located on the base 221.

In order to prevent the container placed on the base 221 from moving, the base 221 may be provided with a movement preventing member 223. The movement preventing member 223 may be provided to enclose at least a portion of the outer circumferential surface of the container which is seated on the seating portion 225. The movement preventing member 223 may be provided to be movable in the radial direction by an elastic member (not shown). The movement preventing member 223 may be provided so as to be pushed outward by the container. That is, the movement preventing member 223 may be deformed into a shape corresponding to an outer shape of the container. When the container is seated on the seating portion 225, the movement preventing member 223 may press an outer surface of the container to fix the container so that it does not move.

A shaft 224 connected to a third driving source 61 (see FIGS. 6 and 7) may be connected to the rear of the holder member 22. The base 221 is arranged long in the longitudinal direction and accommodated in the door 12 and moved forward by the manipulation of the operating unit 4 or the sensing unit 21. After the base 221 is exposed to the front of the door 12, the base 221 is capable of rotating in one direction about the shaft 224. The base 221 rotates in the one direction and arranged long in the horizontal direction. When the base 221 is arranged long in the horizontal direction, one side of the base 221 on which the container is seated faces upward.

Figure 5A:
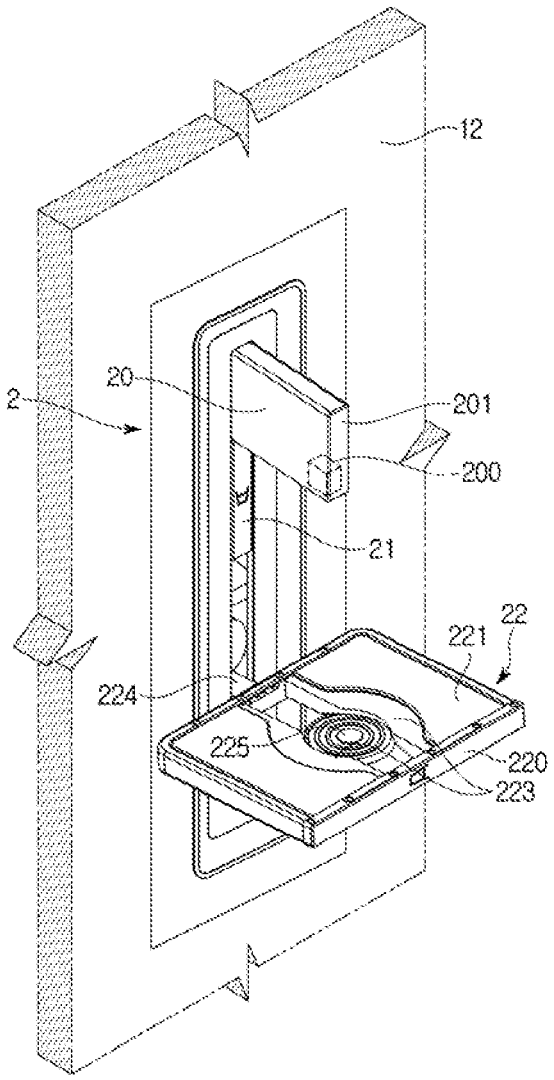
FIGS. 5A and 5B are views illustrating an appearance of the water dispensing unit in which a holder member and a water dispensing member protrude according to an embodiment.
Figure 5B:
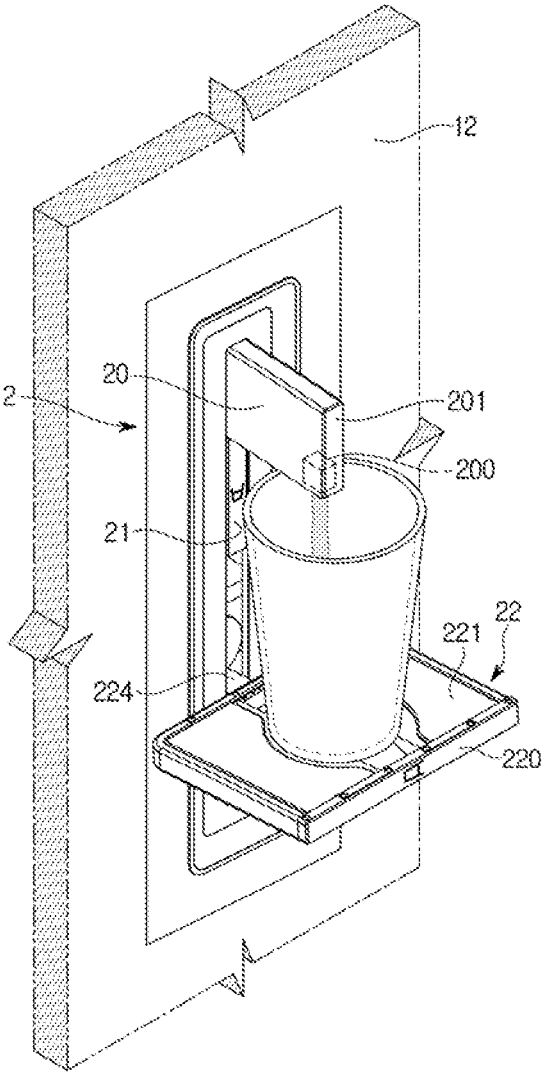

FIGS. 5A and 5B are views illustrating an appearance of the water dispensing unit in which a holder member and a water dispensing member protrude according to an embodiment.

Referring to FIGS. 5A and 5B, when the base 221 according to an embodiment protrudes forward from the door 12, the user may place a container on the base 221. After the base 221 protrudes forward from the door 12, the water dispensing member 20 may protrude forward. The container is placed on the base 221, and water discharged from the outlet 200 may be filled into the container.

Water may be discharged into the container by a predetermined amount. When the discharge of water is stopped, the water dispensing member 20 may move backward and return to its original position. When the user takes out the container from the seating portion 225, the base 221 rotates in the other direction and is arranged long in the longitudinal direction, and then moves backward to return to its original position.

The base 221 may be provided with a sensor (not shown) for detecting whether the container is located on the base 221. The sensor provided on the base 221 may be a contact sensor, an obstacle detecting sensor, a weight detecting sensor, or the like.

As such, the holder member 22 may be provided so as to protrude forward from the door 12 only when necessary for placing the container. Water is supplied into the container with the user placing the container on the holder member 22, which is convenient. When water is not supplied, the holder member 22 does not protrude outside the door 12, so that the deterioration of the appearance quality of the refrigerator 1 by the holder member 22 is prevented.

Figure 6:
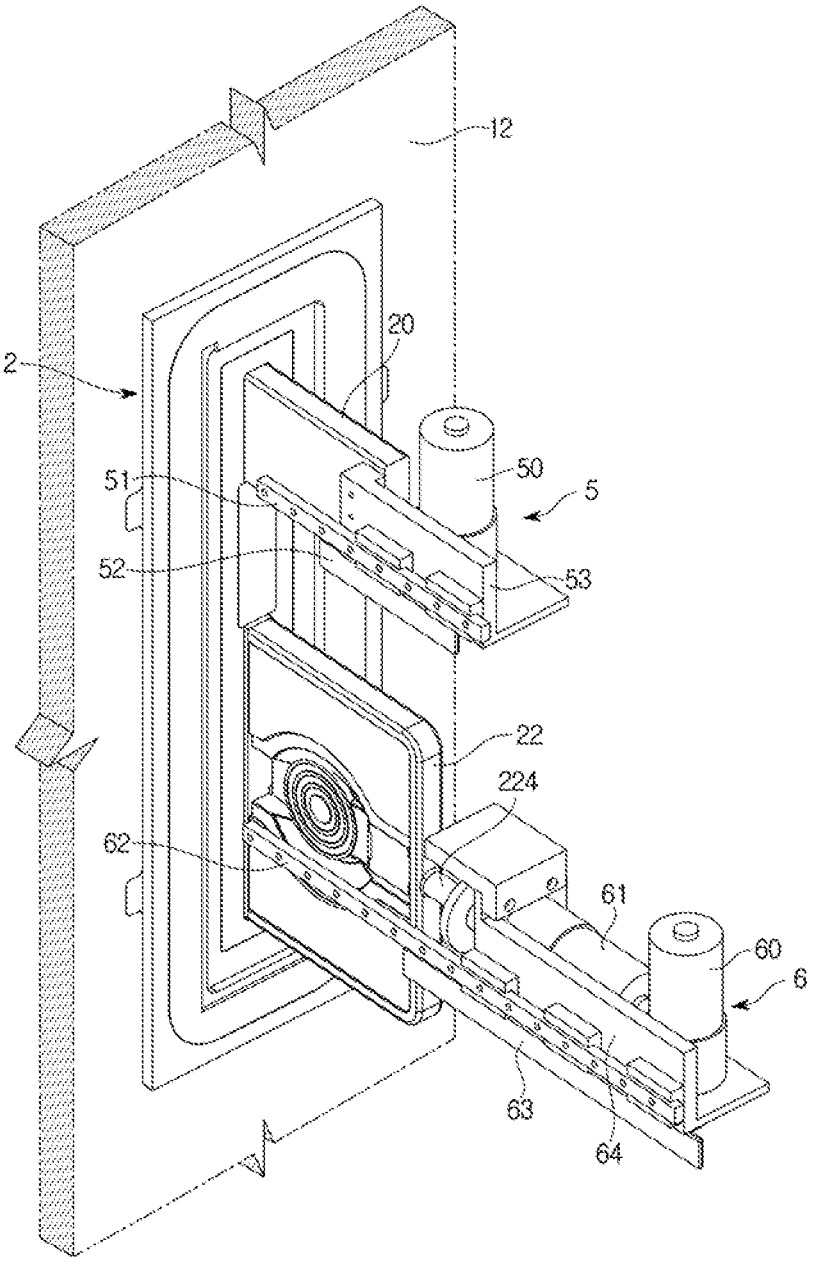
FIGS. 6 and 7 are views illustrating the rear of the water dispensing unit according to the embodiment.
Figure 7:
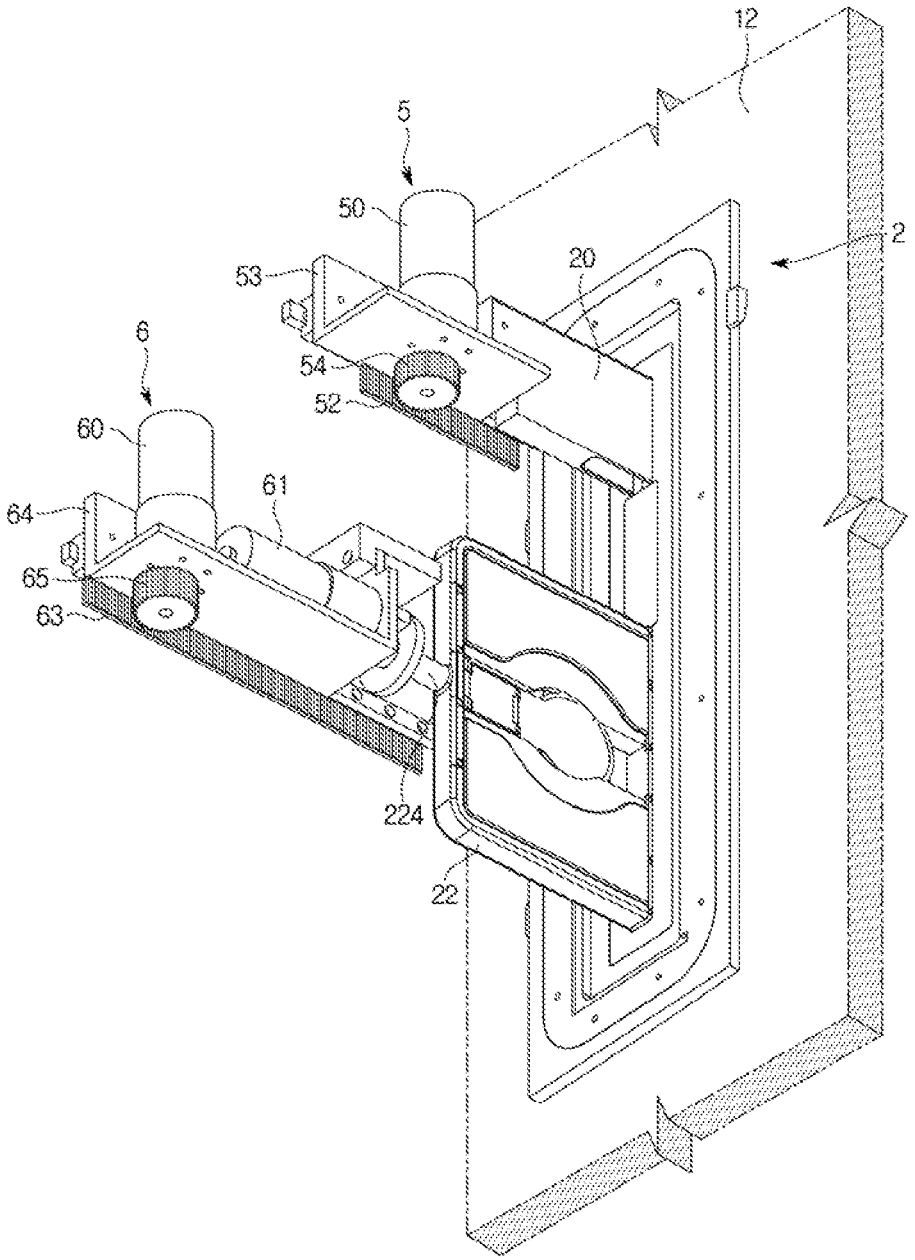

FIGS. 6 and 7 are views illustrating the rear of the water dispensing unit according to the embodiment.

Referring to FIGS. 6 and 7, the water dispensing member 20 and the holder member 22 according to an embodiment may move or rotate in the forward and backward directions by receiving the driving force from the drive units 5, 6.

The water dispensing member 20 and the holder member 22 may be connected to drive sources by pinion gears 54, 65 and rack gears 52, 63 respectively. The structure in which the water dispensing member 20 and the holder member 22 are connected to the drive sources is not limited to the above-described gear connection. Hereinafter, an embodiment in which the water dispensing member 20 and the holder member 22 are connected to the drive sources by the pinion gears and the rack gears will be described.

The connection between the water dispensing member 20 and a first drive source 50 for transmitting the driving force to the water dispensing member 20 will be described. A first rail 51 extending in the forward and backward directions may be provided at the rear of the door 12. The first driving source 50 may be connected to a first bracket 53 provided to be movable in the forward and backward directions along the first rail 51.

The water dispensing member 20 may be mounted on the first bracket 53. When the first bracket 53 moves forward, the water dispensing member 20 protrudes forward from the door 12, and when the first bracket 53 moves backward, the water dispensing member 20 moves backward and is received in the interior of the door 12.

The first rack gear 52 provided in parallel with the first rail 51 may be positioned at one side of the first rail 51. The first driving source 50 may be provided with the first pinion gear 54 that rotates by the driving force of the first driving source 50. When the first pinion gear 54 rotates by the first drive source 50, the first pinion gear 54 moves forward or backward along the first rack gear 52. The first rail 51 guides a movement of the first bracket 53, and guides the first pinion gear 54 to move stably along the first rack gear 52.

The first bracket 53 connected to the first driving source 50 and the first driving source 50 together with the first pinion gear 54 moves forward or backward. The water dispensing member 20 together with the first bracket 53 moves forward or backward.

The holder member 22 also moves in the forward and backward directions by a structure similar to the water dispensing member 20. A second rail 62 extending in the forward and backward directions is provided at the rear of the door 12 and a second driving source 60 may be connected to a second bracket 64 provided to be movable in the forward and backward directions along the second rail 62.

The holder member 22 may be connected to the second bracket 64. When the second bracket 64 moves forward, the holder member 22 moves forward together with the second bracket 64 and protrudes forward from the door 12. When the second bracket 64 moves backward, the holder member 22 moves backward with the second bracket 64 and is accommodated in the interior of the door 12.

The second rack gear 63 provided in parallel with the second rail 62 may be disposed on one side of the second rail 62. The second pinion gear 65 is connected to the second driving source 60 and the second pinion gear 65 is provided so as to be movable in the forward and backward directions along the second rack gear 63 while rotating. The second driving source 60 connected to the second pinion gear 65 also moves in the forward and backward directions along the second rack gear 63 and the second bracket 64 on which the second driving source 60 is mounted and the holder member 22 connected to the second bracket 64 also moves in the forward and backward directions together.

The third driving source 61 to rotate the holder member 22 is further provided on the second bracket 64. The third drive source 61 and the holder member 22 may be connected by the shaft 224. The shaft 224 rotates by receiving the driving force from the third driving source 61. The shaft 224 rotates in one direction or the other direction by the driving force of the third driving source 61 in a state in which the holder member 22 protrudes to the outside of the door 12. The holder member 22 rotates in one direction or the other direction together with the shaft 224.

The structure for moving the water dispensing member 20 or the holder member 22 in the forward and backward directions and the structure for rotating the holder member 22 are not limited to those described above. In the above, the first driving source 50 for moving the water dispensing member 20 in the forward and backward directions and the second driving source 60 for moving the holder member 22 in the forward and backward directions are separately provided. However, it is also possible that the water dispensing member 20 and the holder member 22 are movable in the forward and backward directions by a single driving source, respectively.

As described above, the water dispensing member 20 is provided so as not to protrude forward from the door 12 so as not to deteriorate the aesthetic quality of the refrigerator 1 when water is not discharged. The water dispensing member 20 protrudes forward from the door 12 to discharge water, and after a predetermined amount of water is discharged, it moves backward and returns to its original position.

By providing the holder member 22 on which the container is placed, the user can more conveniently get water. The holder member 22 is positioned so as not to protrude forward from the door 12 when water is not discharged so as not to deteriorate the aesthetic quality of the refrigerator 1.

In the above, in order to improve the appearance quality of the water dispensing unit 2 exposed on the front surface of the door 12, an embodiment in which the holder member 22 is accommodated in the door 12 in a state in which one side of the holder member 22 on which the container is placed faces sideways, and the holder member 22 is provided so as to be rotatable so that the container can be placed on the holder member 22 after the holder member 22 protrudes forward from the door 12 is described.

However, it is also possible that the holder member 22 is accommodated in the door 12 in a state in which one side of the holder member 22 on which the container is placed faces upward, and the holder member 22 is provided to move forward so as to place the container on the holder member 22.

It is also possible that the water dispensing member 20, the sensing unit 21, and the holder member 22 are not located on the same straight line. Also, the water dispensing member 20, the sensing unit 21, and the holder member 22 may have different widths from each other.

Since the water dispensing member 20 and the holder member 22 are provided to be accommodated in the door 12 as described above, the space usability of the door 12 and the aesthetic quality of the appearance of the refrigerator 1 can be improved.

Although a few embodiments of the present invention have been shown and described above, the invention is not limited to the aforementioned specific exemplary embodiments. Those skilled in the art may variously modify the invention without departing from the gist of the invention claimed by the appended claims.

What is claimed is:

1. A refrigerator comprising:

a main body in which a storage space is formed;

a door to open or close a front side of the main body;

a water dispensing member provided on the door and having an outlet; and a sensor provided below the water dispensing member and configured to sense a user input, wherein the water dispensing member is provided so as to be movable forward or backward and is located at a first position accommodated in the door or at a second position protruded forward from the door, when the sensor senses the user input, the water dispensing member moves from the first position to the second position, discharges water by a predetermined amount through the outlet at the second position, and then moves to the first position.

2. The refrigerator according to claim 1, wherein when the water dispensing member is located at the first position, a front surface of the water dispensing member is positioned on the same plane as a front surface of the door.

3. The refrigerator according to claim 1, wherein the sensor is positioned on the same plane as a front surface of the water dispensing member when the water dispensing member is located in the first position.

4. The refrigerator according to claim 1, wherein the sensor has the same width as the water dispensing member.

5. The refrigerator according to claim 1, wherein the user input is done by contacting the sensor.

6. The refrigerator according to claim 1, wherein the user input is done by pressing the sensor.

7. The refrigerator according to claim 1, wherein the user input is done by positioning an object within a predetermined distance in front of the sensor.

8. The refrigerator according to claim 1, wherein a holder member is provided below the water dispensing member to mount a container thereon, and the holder member is provided to be located at a third position at which the holder member is accommodated in the door or in a fourth position at which the holder member protrudes forward from the door.

9. The refrigerator according to claim 8, wherein a front surface of the holder member is positioned on the same plane as a front surface of the door when the holder member is in the third position.

10. The refrigerator according to claim 8; wherein the holder member includes a base on which the container is placed, and when the holder member is at the third position, the base is positioned such that one side of the holder member on which the container is placed faces either a left side or a right side of the main body.

11. The refrigerator according to claim 10, wherein the holder member is configured to rotate in one direction or another direction at the fourth position.

12. The refrigerator according to claim 10, wherein when the holder member rotates in one direction at the fourth position, the base is positioned such that the one side on which the container is placed faces upward.

13. The refrigerator according to claim 10, wherein the base is provided with a movement preventing member provided to surround at least a portion of an outer circumferential surface of the container which is mounted on the base so as to prevent a movement of the container.

14. The refrigerator according to claim 13, wherein the movement preventing member is movable in a radial direction so as to correspond to an outer shape of the container.

15. A refrigerator having a water dispensing unit provided to supply water, the water dispensing unit comprising:

a water dispensing member provided with an outlet and configured to be linearly movable forward or backward;

a holder member positioned below the water dispensing member to position a container thereon and configured to be linearly movable forward or backward of the refrigerator; and a sensor provided below the water dispensing member and configured to sense a user input, wherein one of the water dispensing member and the holder member is located at a first position at which a front surface of the one of the water dispensing member and the holder member is accommodated in one side of the refrigerator and at a second position at which the front surface of the one of the water dispensing member and the holder member protrudes from one surface of the refrigerator, when the sensor senses the user input, the water dispensing member moves from the first position to the second position, discharges water by a predetermined amount through the outlet at the second position, and then moves to the first position.

16. The refrigerator according to claim 15, wherein the holder member is positioned such that one side of the holder member on which the container is placed faces either a left side or a right side of the refrigerator at the first position and faces upward at the second position.

17. The refrigerator according to claim 15, wherein the water dispensing member or the holder member moves along a rack gear extending forward and backward.

18. The refrigerator according to claim 15, wherein the water dispensing member and the holder member are independently movable forward or backward.

* * * * *